US007633496B2

(12) United States Patent
Kasai et al.

(10) Patent No.: US 7,633,496 B2
(45) Date of Patent: Dec. 15, 2009

(54) DISPLAY DEVICE

(75) Inventors: Naruhiko Kasai, Yokohama (JP); Hiroki Awakura, Yokohama (JP); Toshihiro Satou, Mobara (JP); Hajime Akimoto, Kokubunji (JP)

(73) Assignee: Hitachi Displays, Ltd., Chiba-ken (JP)

( * ) Notice: Subject to any disclaimer, the term of this patent is extended or adjusted under 35 U.S.C. 154(b) by 828 days.

(21) Appl. No.: 10/989,299

(22) Filed: Nov. 17, 2004

(65) Prior Publication Data

US 2005/0212783 A1 Sep. 29, 2005

(30) Foreign Application Priority Data

Mar. 25, 2004 (JP) ..... 2004-088468

(51) Int. Cl.
*G09G 5/00* (2006.01)

(52) U.S. Cl. ..... 345/208; 345/76

(58) Field of Classification Search ..... 345/204–206, 345/208, 690, 691, 76–78, 80, 82
See application file for complete search history.

(56) References Cited

U.S. PATENT DOCUMENTS

| | | | | |
|---|---|---|---|---|
| 6,753,834 | B2 * | 6/2004 | Mikami et al. | 345/76 |
| 7,095,396 | B2 * | 8/2006 | Ohta et al. | 345/94 |
| 7,145,532 | B2 * | 12/2006 | Kageyama et al. | 345/77 |
| 7,187,355 | B2 * | 3/2007 | Tam et al. | 345/98 |
| 7,358,935 | B2 * | 4/2008 | Yamashita et al. | 345/76 |
| 2002/0196213 | A1 | 12/2002 | Akimoto et al. | |
| 2003/0080951 | A1 * | 5/2003 | Fujiwara et al. | 345/204 |

* cited by examiner

*Primary Examiner*—Richard Hjerpe
*Assistant Examiner*—Tom V Sheng
(74) *Attorney, Agent, or Firm*—Brundidge & Stanger, P.C.

(57) ABSTRACT

A display control circuit and a display unit are provided. The display control circuit generates a sweep signal that is at a fixed voltage level for an arbitrary period. The display unit compares the magnitude of a signal voltage that is written by a data line drive circuit in accordance with display data and the magnitude of the sweep signal generated by the display control circuit, and exercises illumination/nonillumination control in accordance with the comparison result.

5 Claims, 8 Drawing Sheets

DISPLAY DEVICE

CROSS REFERENCE TO RELATED APPLICATION

This application relates to and claims priority from Japanese Patent Application Serial No. 2004-88468 filed on Mar. 25, 2004, the entire disclosure of which is incorporated herein by reference.

BACKGROUND OF THE INVENTION

The present invention relates to a display device that is capable of controlling its luminance in accordance with the amount of current applied to a display element or the duration of illumination, and more particularly to a display device that drives a light-emitting diode (LED), organic EL (organic electroluminescence) element, or other self-luminous display element.

A self-luminous element based illumination control method disclosed by U.S. patent application Publication No. 2002/196213 (JP-A-2003-5709) switches between a data write period and drive period in a data write line and provides a drive period in the other lines. This patent document states that the waveform generated by a drive signal line represents a sweep signal, which varies from a maximum potential to a minimum potential during drive period. Thus, periods other than a horizontal write period are for drive. As a result, the luminance of a self-luminous element can be raised.

SUMMARY OF THE INVENTION

The above-mentioned conventional technology enters a triangular wave after a data write, that is, provides a drive period after termination of a data write period. Therefore, the above conventional technology is at an advantage in that the self-luminous element illumination period can be rendered long enough to raise the luminance. However, a "hold type" drive results as is the case with a liquid-crystal display device. Thus, the image quality of moving pictures deteriorates, thereby blurring the moving pictures.

The present invention provides a display device that improves the image quality for displaying moving pictures.

The present invention includes a display control circuit that fixes a triangular wave input at a voltage level at which no illumination occurs without regard to a data signal voltage during an arbitrary period within a 1-frame period.

Further, the present invention includes a display control circuit that judges a still picture from display data and switches to a triangular wave having a 1-frame period without providing the above-mentioned fixed level.

The present invention makes it possible to improve the image quality of moving picture display without having to convert input display data to generate a black display indication, change the pixel configuration of a self-luminous element based display, or furnish a new switch for inserting a black display indication.

Since the present invention generates a sweep signal in accordance with a display image, it provides a display device that is suitable for both DVCs (digital video cameras) and TVs, which mainly display moving pictures, and DSCs (digital still cameras), which mainly display still pictures, without changing the employed panel structure.

DETAILED DESCRIPTION OF THE PREFERRED EMBODIMENTS OF THE INVENTION

A display control circuit for generating a display control signal for a self-luminous element based display from an input timing signal exercises control to provide a fixed voltage for an arbitrary period when generating a sweep signal.

A first embodiment of the present invention will now be described in detail with reference to the accompanying drawings.

Figure 1:
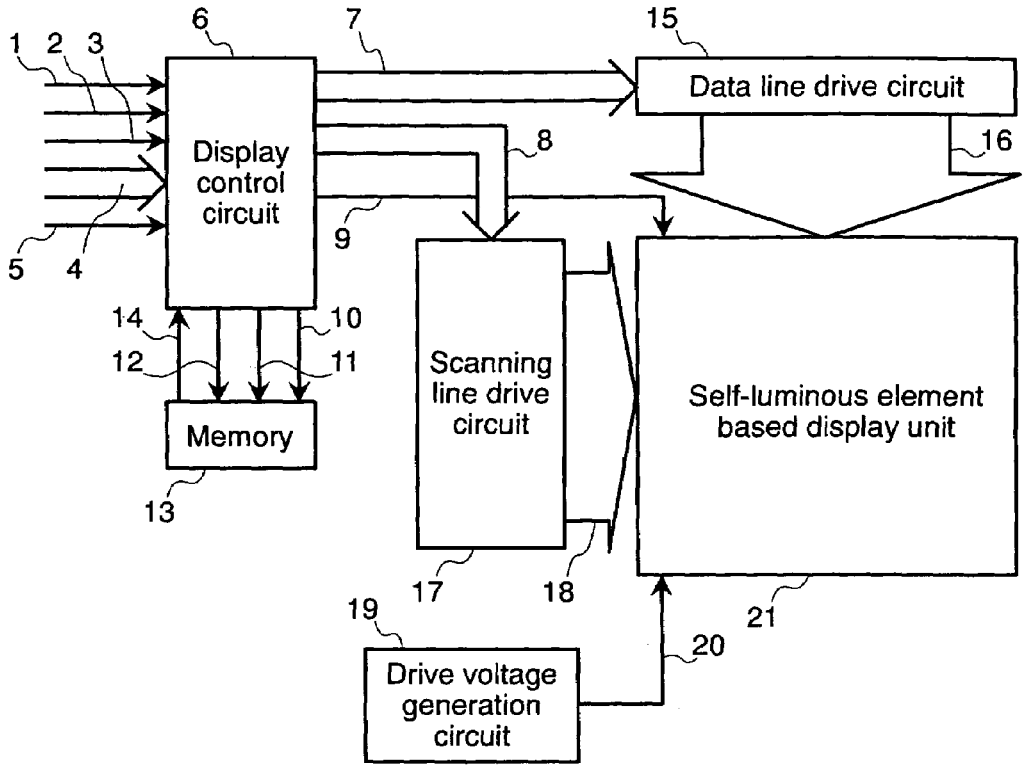
FIG. 1 is a block diagram illustrating a first embodiment of a self-luminous element based display device according to the present invention.

FIG. 1 shows an example of a self-luminous element based display device according to the first embodiment of the present invention. In FIG. 1, the reference numeral 1 denotes a vertical sync signal; 2, a horizontal sync signal; 3, a data enable signal; 4, display data (either analog or digital); and 5, a sync clock. The vertical sync signal 1 is a 1-screen period (1-frame period) signal. The horizontal sync signal 2 is a 1-horizontal period signal. The data enable signal 3 is a signal that indicates a period during which display data 4 is valid (display validity period). All signals are entered in synchronism with the sync clock 5.

In the present embodiment, it is assumed that the display data 4 for one screenful is sequentially transferred by a raster scan method, beginning with a pixel in the upper left corner of the screen, and that one pixel of information includes 6-bit (64-step gradation) digital data.

The reference numeral 6 denotes a moving-picture-ready self-luminous element based display control circuit; 7, a data line control signal; 8, a scanning line control signal; 9, a moving-picture-ready sweep signal; 10, a storage/read command signal; 11, a storage/read address; 12, storage data; 13, a memory circuit for storing one screenful of display data; and 14, screen read data.

The moving-picture-ready self-luminous element based display control circuit 6 generates a storage/read command signal 10, storage/read address 11, and storage data 12 for temporarily storing at least one screenful of display data 4 of the self-luminous element based display unit 21 into the memory 13. Further, the moving-picture-ready self-luminous element based display control circuit 6 generates a storage/read command signal 10 and storage/read address 11 in order to read one screenful of display data in accordance with the display timing of the self-luminous element based display unit 21.

The memory 13 stores the storage data 12 or reads the screen read data 14 in accordance with the storage/read command 10 and storage/read address 11. The moving-picture-ready self-luminous element based display control circuit 6 generates a data line control signal 7, scanning line control signal 8, and moving-picture-ready sweep signal 9 from the screen read data 14, vertical sync signal 1, horizontal sync signal 2, data enable signal 3, and sync clock 5.

The reference numeral 15 denotes a data line drive circuit; 16, a data line drive signal; 17, a scanning line drive circuit; 18, a pixel control drive signal; 19, a drive voltage generation circuit; 20, a self-luminous element drive voltage; and 21, a self-luminous element based display unit.

The self-luminous element based display unit 21 is a display that uses a light-emitting diode, organic EL element, or other similar display element. The self-luminous element based display unit 21 includes a pixel section containing a plurality of self-luminous elements that are arranged in matrix format.

The operation for displaying onto the self-luminous element based display unit 21 is performed by writing data into the pixel section, which is selected and write-controlled by a pixel control drive signal 18 that is output from the scanning line drive circuit 17, in accordance with signal voltage and moving-picture-ready sweep signal 9 application, which is based on a data line drive signal 16 output from the data line drive circuit 15. The voltage for driving the self-luminous element is supplied as the self-luminous element drive voltage 20. The data line drive circuit 15 and scanning line drive circuit 17 may be implemented respectively by an LSI, implemented by a single LSI, or formed on the same glass substrate as for the pixel section.

In the present embodiment, the self-luminous element based display unit 21 has a resolution of 240×320 dots. Each dot includes three pixels. From left to right, the pixels are R (red), G (green), and B (blue). In other words, the present embodiment is described below on the assumption that the display includes 720 pixels horizontally.

The self-luminous element based display unit 21 is capable of adjusting the luminance of the self-luminous element by varying the amount of electrical current flow to the self-luminous element and the duration of self-luminous element illumination. The larger the amount of electrical current flow to the self-luminous element, the higher the luminance of the self-luminous element. The longer the duration of self-luminous element illumination, the higher the luminance of the self-luminous element.

The data line drive circuit 15 generates a signal voltage that is to be written into the self-luminous element in accordance with the display data 4 contained in the data line control signal 7. The moving-picture-ready self-luminous element based display control circuit 6 generates the moving-picture-ready sweep signal 9, compares the signal voltage written by the self-luminous element based display unit 21 against the voltage level of the moving-picture-ready sweep signal 9, and controls the duration of self-luminous element illumination.

Figure 2:
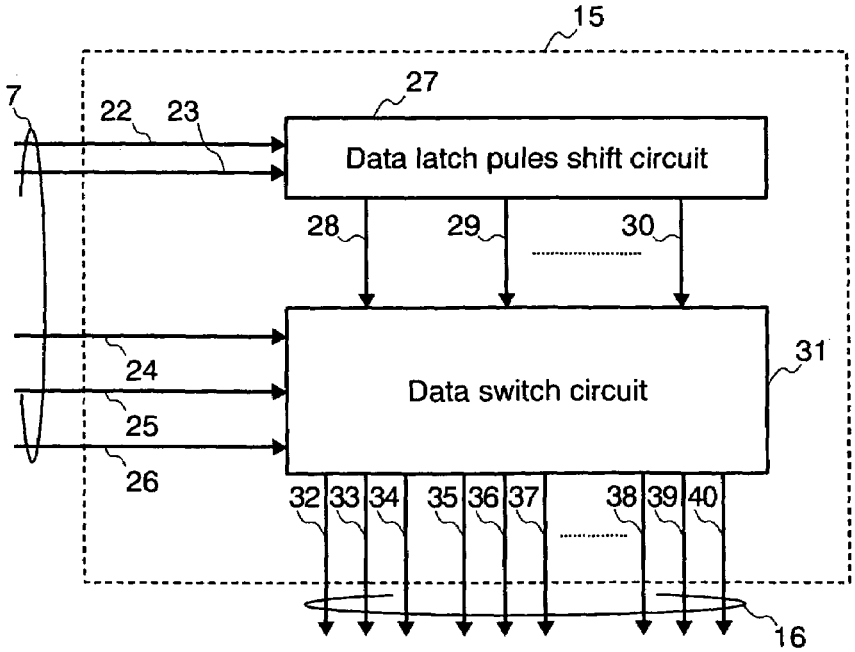
FIG. 2 illustrates an internal configuration of a data line drive circuit 15.

FIG. 2 illustrates one embodiment of an internal configuration of the data line drive circuit 15 that is shown in FIG. 1. In FIG. 2, the reference numeral 22 denotes a data latch start pulse; 23, a data latch shift clock; 24, an analog R display data; 25, an analog G display data; and 26, an analog B display data. These signals constitute the data line control signal 7.

The reference numeral 27 denotes a data latch pulse shift circuit; 28, a first dot data latch signal; 29, a second dot data latch signal; and 30, a 240th dot data latch signal. The data latch pulse shift circuit 27 shifts the data latch start pulse 22, which indicates the beginning of horizontal data, to the right in accordance with the data latch shift clock 23, and then sequentially outputs the first dot data latch signal 28, the second dot data latch signal 29, and so on up to the 240th dot data latch signal 30 because the self-luminous element based display unit 21 according to the present embodiment has a horizontal resolution of 240 dots as described earlier.

The reference numeral 31 denotes a data switch circuit; 32, a first dot R signal; 33, a first dot G signal; 34, a first dot B signal; 35, a second dot R signal; 36, a second dot G signal; 37, a second dot B signal; 38, a 240th dot R signal; 39, a 240th dot G signal; and 40, a 240th dot B signal. The data switch circuit 31 outputs, in accordance with the timing of the first dot data latch signal 28, the analog R display data 24 as the first dot R signal 32, the analog G display data 25 as the first dot G signal 33, and the analog B display data 26 as the first dot B signal 34; and outputs, in accordance with the timing of the second dot data latch signal 29, the analog R display data 24 as the second dot R signal 35, the analog G display data 25 as the second dot G signal 36, and the analog B display data 26 as the second dot B signal 37. The data switch circuit 31 then continues to sequentially output various dot R/G/B signals in accordance with various dot data latch signals. Finally, the data switch circuit 31 outputs, in accordance with the timing of the 240th dot data latch signal 30, the analog R display data 24 as the 240th dot R signal 38, the analog G display data 25 as the 240th dot G signal 39, and the analog B display data 26 as the 240th dot B signal 40.

Figure 3:
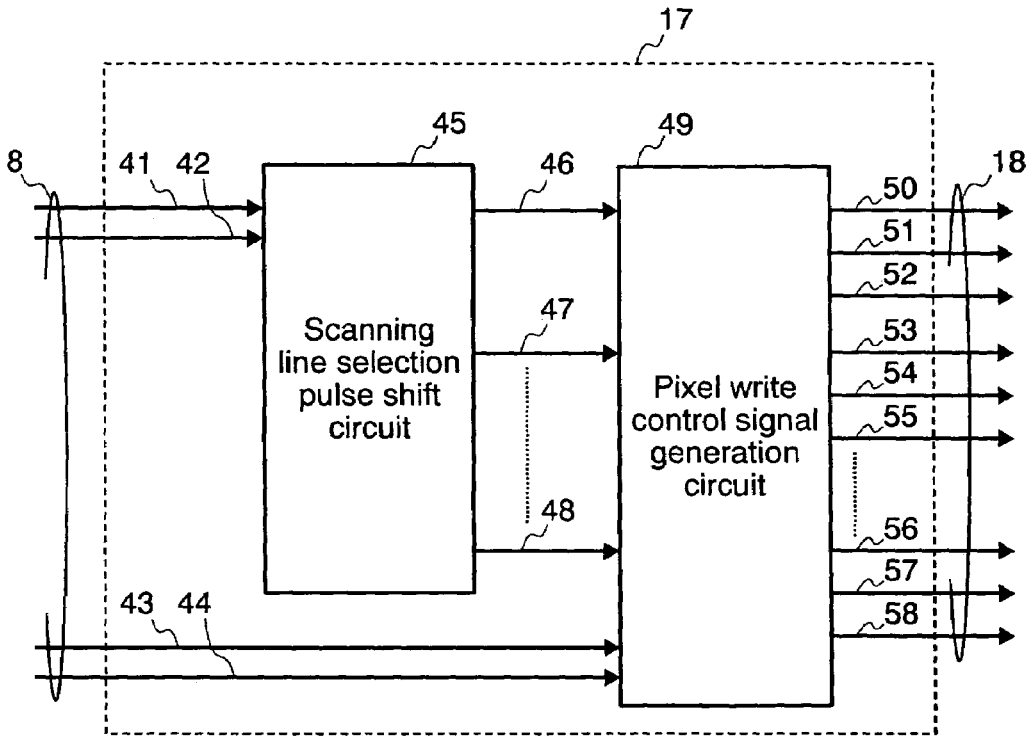
FIG. 3 illustrates an internal configuration of a scanning line drive circuit 17.

FIG. 3 illustrates one embodiment of an internal configuration of the scanning line drive circuit 17 that is shown in FIG. 1. In FIG. 1, the reference numeral 41 denotes a scanning line selection start pulse; 42, a scanning line selection shift clock; 43, a pixel reset signal; and 44, a pixel write signal. These signals constitute the scanning line drive signal 8.

The reference numeral 45 denotes a scanning line selection pulse shift circuit; 46, a first scanning line selection pulse; 47, a second scanning line selection pulse; and 48, a 320th scanning line selection pulse. The scanning line selection pulse shift circuit 45 shifts the scanning line selection start pulse 41, which indicates the beginning of vertical scanning, downward in accordance with the scanning line selection shift clock 42, and then sequentially outputs the first scanning line selection pulse 46, second scanning line selection pulse 47, and so on up to the 320th scanning line selection pulse 48 for individual scanning line selection purposes.

The reference numeral 49 denotes a pixel write control signal generation circuit; 50, a first scanning line reset pulse; 51, a first scanning line data write pulse; 52, a first scanning line triangular wave selection pulse; 53, a second scanning line reset pulse; 54, a second scanning line data write pulse; 55, a second scanning line triangular wave selection pulse;

56, a 320th scanning line reset pulse; 57, a 320th scanning line data write pulse; and 58, a 320th scanning line triangular wave selection pulse.

By using the pixel reset signal 43, which indicates the timing for resetting an inverter within the pixel section described later, the pixel write signal 44, which indicates the timing for a data write, and the first to 320th scanning line selection pulses 46-48, which indicate the timing for selecting individual scanning lines, the pixel write control signal generation circuit 49 generates the first scanning line reset pulse 50 for controlling the after-mentioned pixel section on the first scanning line, the first scanning line write pulse 51, the first scanning line triangular selection pulse 52, the second scanning line reset pulse 53 for controlling the pixel section on the second scanning line, the second scanning line data write pulse 54, the second scanning line triangular wave selection pulse 55, the 320th scanning line reset pulse 56 for controlling the pixel section on the 320th scanning line, the 320th scanning line data write pulse 57, and the 320th scanning line triangular wave selection pulse 58, and outputs them as the pixel control drive signal 18.

Figure 4:
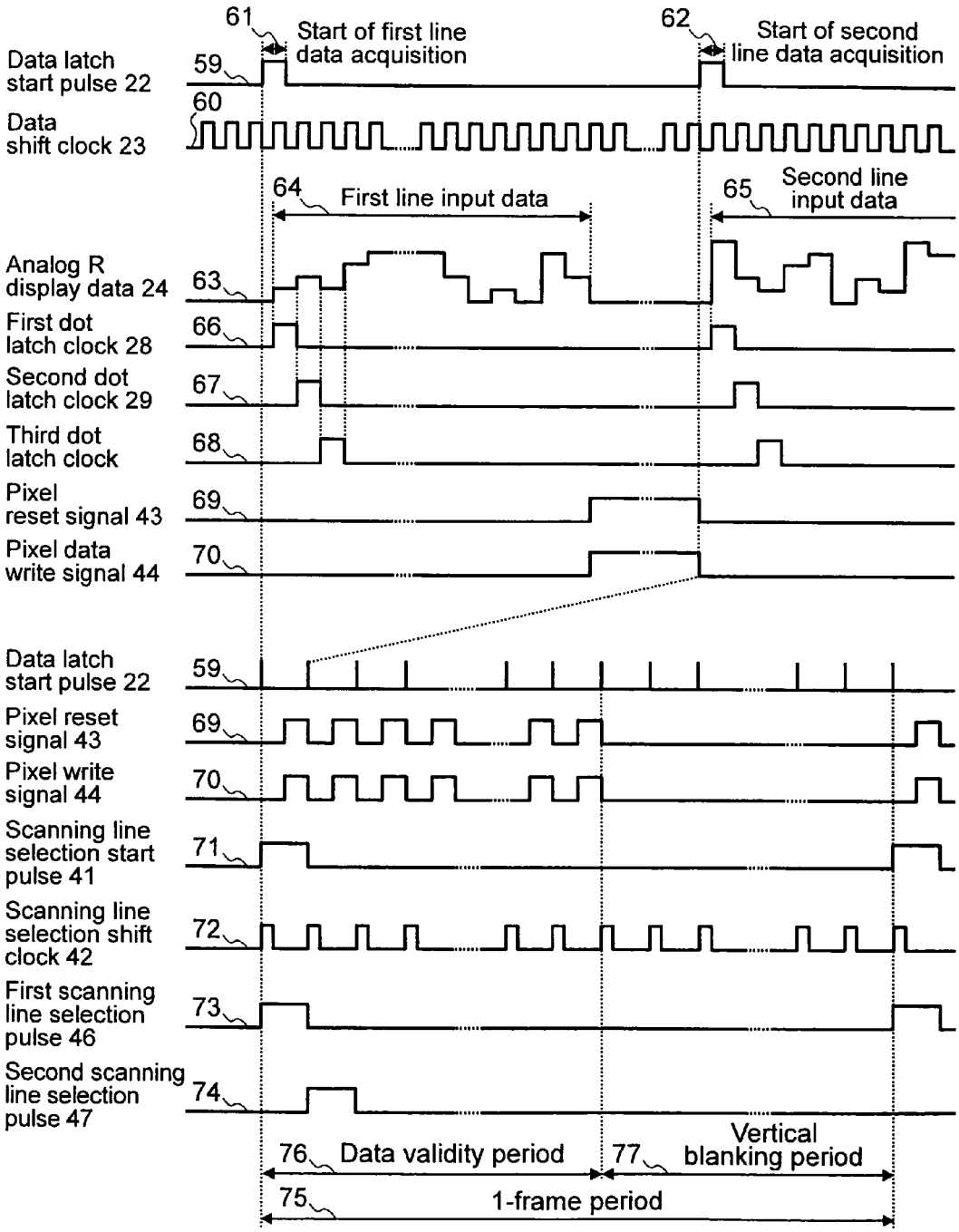
FIG. 4 illustrates how signals are generated by a data line drive circuit 15 and scanning line drive circuit 17.

FIG. 4 illustrates how signals are generated by the data line drive circuit 15 and scanning line drive circuit 17. In FIG. 4, the reference numeral 59 denotes a data latch start pulse waveform; 60, a data latch shift clock waveform; 61, a first line data acquisition start time; and 62, a second line data acquisition start time. The High period of the data latch start pulse waveform 59 represents the first line data acquisition start time 61 and second line data acquisition start time 62, which both indicate the beginning of data acquisition.

The reference numeral 63 denotes an analog R display data waveform; 64, a first line input data period; and 65, a second line input data period. The analog R display data waveform 63 outputs analog data during the first line input data period 64, which begins at the first line data acquisition start time 61, and during the second line input data period 65, which begins at the second line data acquisition start time 62. Similarly, the analog R display data waveform 63 outputs analog data during the subsequent line input data periods up to the one for the 320th line. Although only the analog R display data waveform is described herein, the same data period applies to the analog R, analog G, and analog B display data.

The reference numeral 66 denotes a first dot latch clock waveform; 67, a second dot latch clock waveform; and 68, a third dot latch clock waveform. The first to third dot latch clock waveforms 66-68 output the data latch start pulse waveform 59 while sequentially shifting it one dot to the right (first→second→ . . . →240th) in compliance with the data latch shift clock 60.

The reference numeral 69 denotes a pixel reset signal waveform whereas the reference numeral 70 denotes a pixel data write signal waveform. They go High at the end of a data period for each line and represent a signal waveform for pixel section control, which will be described later. In a line into which no data is input (vertical blanking period), the High level does not occur. The ensuing explanation assumes that the pixel reset signal waveform 69 and pixel data write signal waveform 70 exhibit the same waveform.

The reference numeral 71 denotes a scanning line selection start pulse waveform; 72, a scanning line selection shift clock waveform; 73, a first scanning line selection pulse waveform; and 74, a second scanning line selection pulse waveform. The High level of the scanning line selection start pulse waveform 71 indicates the start of 1-frame screen scanning. The High level sequentially occurs in accordance with the scanning line selection shift clock waveform 72 as indicated by the first scanning line selection pulse waveform 73 and second scanning line selection pulse waveform 74. The reference numeral 75 denotes a 1-frame period; 76, a data validity period (non-blanking period); and 77, a vertical blanking period.

One period of the scanning line selection start pulse waveform 71, that is, the period for writing one screenful of data, is the 1-frame period 75. Within the 1-frame period 75, a period during which the analog R display data waveform 63, pixel reset signal waveform 69, and pixel data write signal waveform 70 are entered is the data validity period 76. The remaining period during which no data is entered is the vertical blanking period 77.

Figure 5:
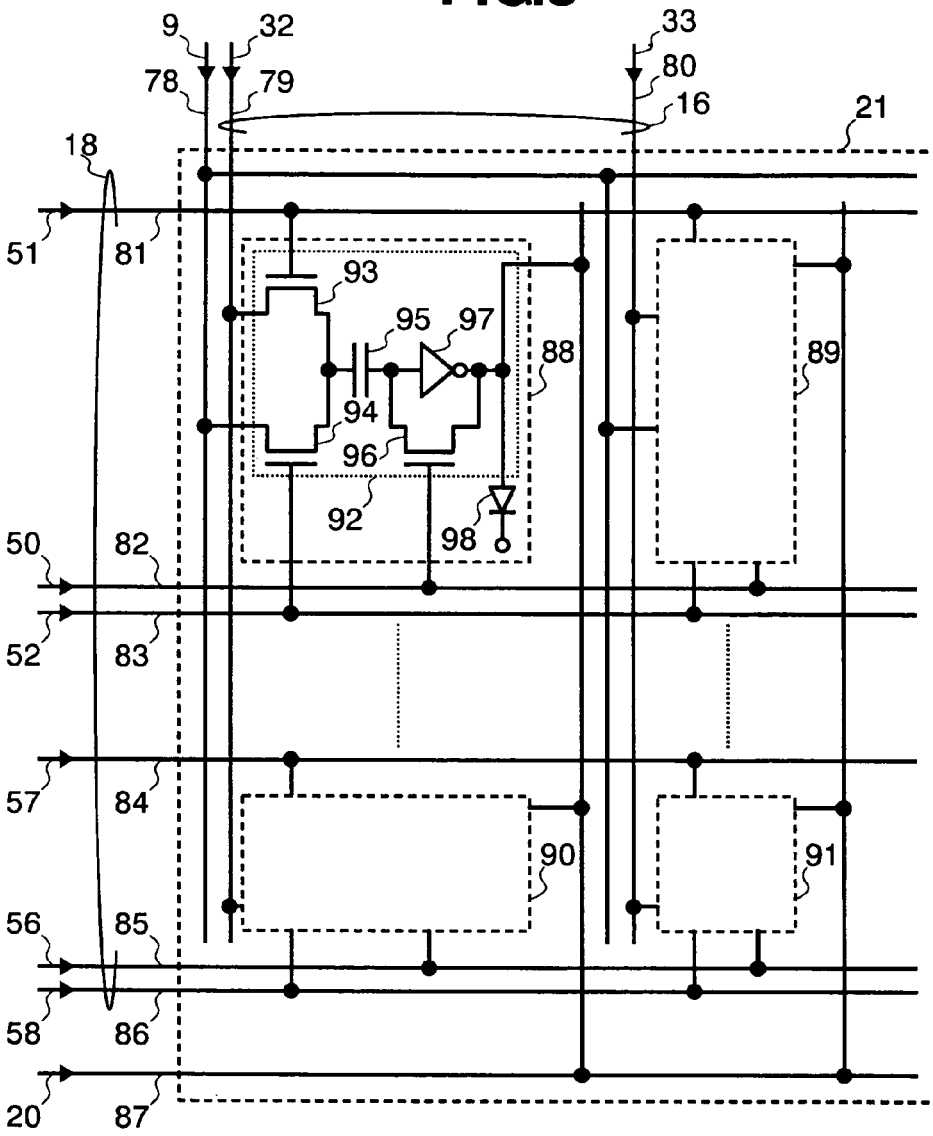
FIG. 5 illustrates an internal configuration of a self-luminous element based display unit 21.

FIG. 5 illustrates one embodiment of an internal configuration of the self-luminous element based display unit 21 that is shown in FIG. 1. In the example shown in FIG. 5, an organic EL element is used as the self-luminous element. In FIG. 5, the reference numeral 78 denotes a sweep signal line; 79, a first dot R data line; 80, a first dot G data line; 81, a first line pixel write control line; 82, a first line pixel reset control line; 83, a first line triangular wave selection control line; 84, a 320th line pixel write control line; 85, a 320th line pixel reset control line; 86, a 320th line triangular wave selection control line; 87, an organic EL drive voltage supply line; 88, a first-row first-column pixel section; 89, a first-row second-column pixel section; 90, a 320th-row first-column pixel section; and 91, a 320th-row second-column pixel section.

The first dot R data line 79 and first dot G data line 80 are signal lines that respectively enter the first dot R signal 32 and first dot G signal 33 into the pixel section. The first line pixel write control line 81 and 320th line pixel write control line 84 are signal lines that respectively enter the first scanning line data write pulse 51 and 320th scanning line data write pulse 57 into the pixel section. The first line pixel reset control line 82 and 320th line pixel reset control line 85 are signal lines that respectively enter the first scanning line pixel reset pulse 50 and 320th scanning line pixel reset pulse 56 into the pixel section. The first line triangular wave selection control line 83 and 320th line triangular wave selection control line 86 are signal lines that respectively enter the first scanning line triangular wave selection pulse 52 and 320th scanning line triangular wave selection pulse 58 into the pixel section.

A signal voltage is written into the pixel sections on lines selected by various pixel write control lines and pixel reset control lines via various data lines. A triangular wave is supplied to the pixel sections on lines selected by various triangular wave selection control lines via the sweep signal line 78. In accordance with the signal voltage and triangular wave, the organic EL drive voltage supplied from the organic EL drive voltage supply line 87 controls the illumination time of a pixel section that illuminates. Although only the pixel section internal configuration of the first-row first-column pixel section 88 is illustrated, the same configuration also applies to the first-row second-column pixel section 89, 320th-row first-column pixel section 90, and 320-row second-column pixel section 91.

The reference numeral 92 denotes a pixel drive section; 93, a data write switch; 94, a triangular wave switch; 95, a write capacitor; 96, a reset switch; 97, a drive inverter; and 98, an organic EL element. The pixel drive section 92 controls the illumination time of the organic EL element 98 in accordance with a signal voltage, and includes the data write switch 93, triangular wave switch 94, write capacitor 95, reset switch 96, and drive inverter 97.

The data write switch 93 is turned ON by the first line pixel write control line 81. The reset switch 96 is turned ON by the first line pixel reset control line 82. When the reset switch 96 turns ON, the input and output of the drive inverter 97 is shorted so that a reference voltage is set in accordance with the characteristics of a transistor that forms the drive inverter 97 of each pixel section. The reference voltage is then used as the reference so that a signal voltage supplied from the first dot R data line 79 is stored in the write capacitor 95.

After a signal voltage write, the triangular switch 94 is turned ON by the first line triangular wave selection control line 83. When the triangular switch 94 turns ON, the moving-picture-ready sweep signal 9 enters the drive inverter 97. If the voltage of the sweep signal is higher than the signal voltage stored in the write capacitor 95, the drive inverter 97 turns OFF the organic EL element 98. If the voltage of the sweep signal is lower than the signal voltage stored in the write capacitor 95, the drive inverter 97 turns ON the organic EL element 98. As described above, illumination time control is exercised over the organic EL element 98 in accordance with the signal voltage.

As described earlier, the number of pixels of the self-luminous element based display unit 21 is 240×320. Therefore, there are 320 horizontal lines each for pixel write control, reset control, and triangular wave selection control (the first to 320th lines are arranged in the vertical direction). When the R, G, and B control lines are added together, the total number of control lines is 960. There are 240 vertical data lines (the first to 240th dots are arranged in the horizontal direction). When the R, G, and B data lines are added together, the total number of data lines is 720.

The ensuing explanation assumes that the sweep signal line 78, which is parallel to the data lines, is routed from the top of the self-luminous element based display unit 21 to all the pixel sections, and that the organic EL drive voltage supply line 87, which is parallel to the data lines, is routed from the bottom of the self-luminous element based display unit 21 to all the pixel sections. In other words, it is assumed for explanation purposes that a total of 2160 (720+720×2) vertical lines are arranged in horizontal direction.

Figure 6:
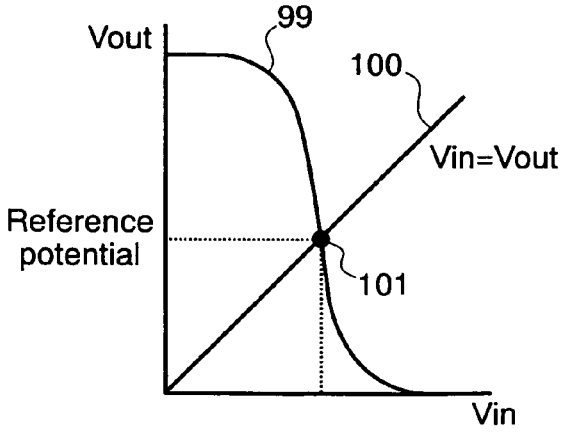
FIG. 6 illustrates the setup of a reference signal voltage for a drive inverter 97.

FIG. 6 illustrates the setup of a reference signal voltage for the drive inverter 97 shown in FIG. 5. In FIG. 5, the reference numeral 99 denotes an input/output characteristic of the drive inverter 97; 100, input/output shorting conditions; and 101, a signal voltage write reference potential for the drive inverter 97. As described earlier, the input and output of the drive inverter 97 are shorted at the time of a data write. Therefore, the input and output potentials coincide with the signal voltage write reference potential 101, which corresponds to the intersection of a curve indicating the input/output characteristic 99 and a straight line (Vin=Vout) indicating the input/output shorting conditions 100. A signal voltage write is performed with reference to this signal voltage write reference potential 101.

Figure 7:
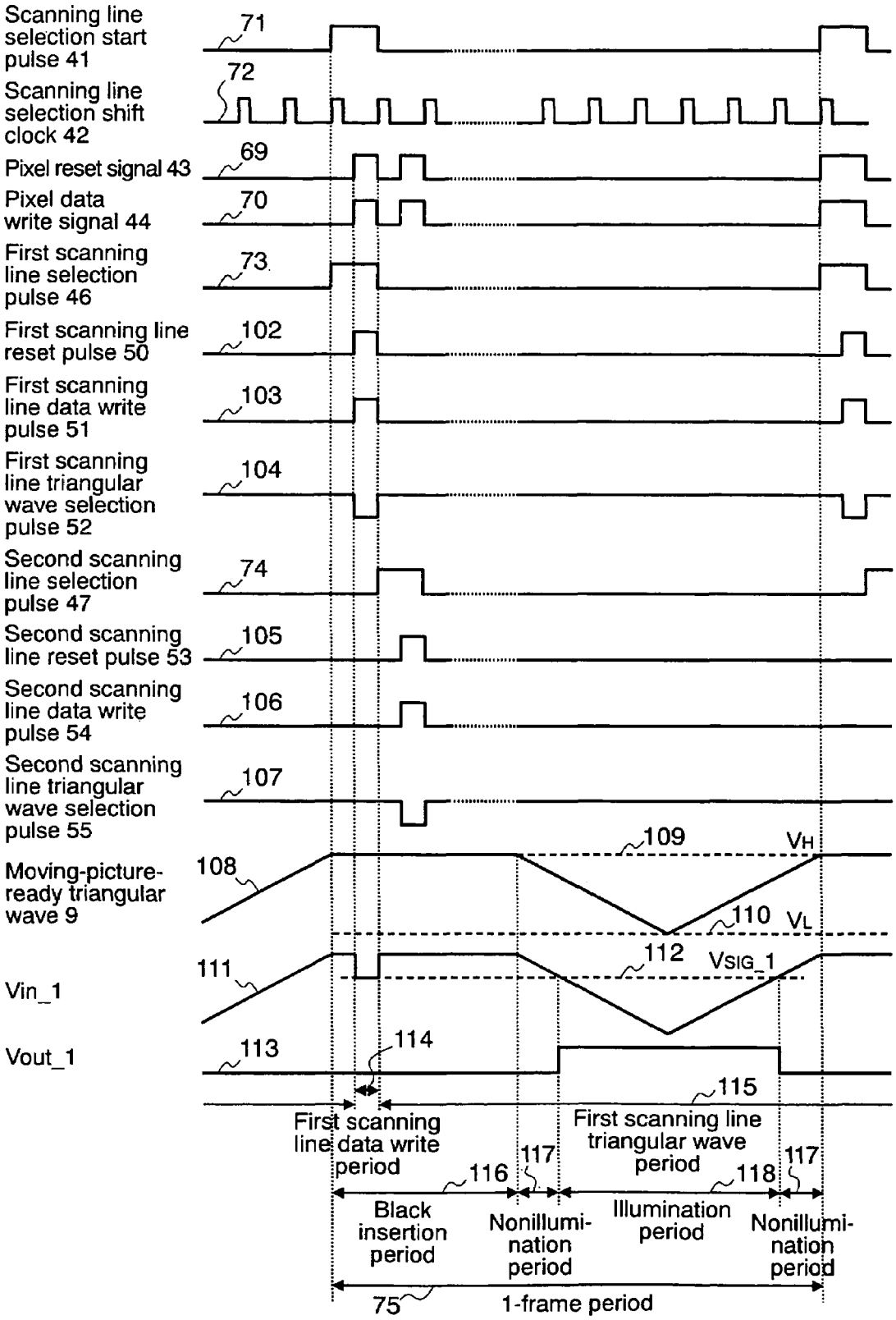
FIG. 7 illustrates an operation of a pixel write control signal generation circuit 49 and a signal voltage write operation and triangular wave based illumination time control operation of a first-row first-column pixel section 88.

FIG. 7 illustrates an operation of the pixel write control signal generation circuit 49 shown in FIG. 3 and a signal voltage write operation and triangular wave based illumination time control operation of the first-row first-column pixel section 88 shown in FIG. 5. In FIG. 7, the reference numeral 102 denotes a first scanning line reset pulse waveform; 103, a first scanning line data write pulse waveform; 104, a first scanning line triangular wave selection pulse waveform; 105, a second scanning line reset pulse waveform; 106, a second scanning line data write pulse waveform; 107, a second scanning line triangular wave selection pulse waveform; 108, a sweep signal waveform; 109, a triangular wave High voltage; 110, a triangular wave Low voltage; 111, a first-row first-column pixel section drive inverter input; 112, a first-row first-column pixel section signal voltage; 113, a first-row first-column pixel section drive inverter output; 114, a first scanning line data write period; 115, a first scanning line triangular wave period; 116, a black insertion period; 117, a first-row first-column pixel nonillumination period; and 118, a first-row first-column pixel illumination period.

The first scanning line reset pulse waveform 102 is in the Low state under normal conditions. It goes High when the first scanning line selection pulse waveform 73 and pixel reset signal waveform 69 are both High. The first scanning line data write pulse waveform 103 is in the Low state under normal conditions. It goes High when the first scanning line selection pulse waveform 73 and pixel data write signal waveform 70 are both High. The first scanning line triangular wave selection pulse waveform 104 is in the High state under normal conditions. It goes Low when the first scanning line selection pulse waveform 73 and pixel data write signal waveform 70 are both High.

The second scanning line reset pulse waveform 105 is in the Low state under normal conditions. It goes High when the second scanning line selection pulse waveform 74 and pixel reset signal waveform 69 are both High. The second scanning line data write pulse waveform 106 is in the Low state under normal conditions. It goes High when the second scanning line selection pulse waveform 74 and pixel data write signal waveform 70 are both High. The second scanning line triangular wave selection pulse waveform 107 is in the High state under normal conditions. It goes Low when the second scanning line selection pulse waveform 74 and pixel data write signal waveform 70 are both High.

In other words, the pixel write control signal generation circuit 49 enables the reset pulse and data write pulse only when the scanning line selection pulse waveforms are High. When the scanning line selection pulse waveforms are not High, the pixel write control signal generation circuit 49 enables the triangular wave selection pulse.

The ensuing explanation assumes that the pixel reset signal waveform 69 is identical with the pixel data write signal waveform 70. The sweep signal waveform 108 remains constant as a triangular wave High voltage 109 ($V_H$) for an arbitrary period within a 1-frame period 75, varies to a triangular wave Low voltage 110 ($V_L$), and then reverts to the triangular wave High voltage 109. It is preferred that the triangular wave High voltage 109 be higher than the highest among a plurality of signal voltages.

While the first scanning line reset pulse waveform 102 is High during the first scanning line data write period 114, the first-row first-column pixel section drive inverter input 111 writes the first-row first-column pixel section signal voltage 112 (Vsig_1). After termination of the write, the first scanning line triangular wave period 115 switches to the sweep signal waveform 108.

The potential Vsig_1 written herein is retained by the write capacitor 95 and used as a threshold voltage for the drive inverter 97. Therefore, the first-row first-column pixel section drive inverter output 113 is Low while the triangular wave voltage is higher than Vsig_1 during the first scanning line triangular wave period 115 and High while the triangular wave voltage is lower than Vsig_1.

Therefore, while the first-row first-column pixel section drive inverter output 113 is Low, the power supply to the organic EL element 98 is shut off so that a nonillumination period 117 results. While the first-row first-column pixel section drive inverter output is High, power is supplied to the organic EL element 98 so that an illumination period 118 results.

When the sweep signal waveform 108 is a triangular wave High voltage 109, nonillumination results without regard to the Vsig_1 level. Therefore, the resulting display is such that a black insertion period 116 occurs for a black screen. The illumination period according to the signal voltage is determined in the above manner. The ensuing explanation assumes that the above data input and triangular wave input operations are performed at regular intervals and within a 1-frame period 75, which represents a frequency of 60 Hz. The black insertion period 116 is a blanking period during which the gradation according to the display data is not displayed.

Figure 8:
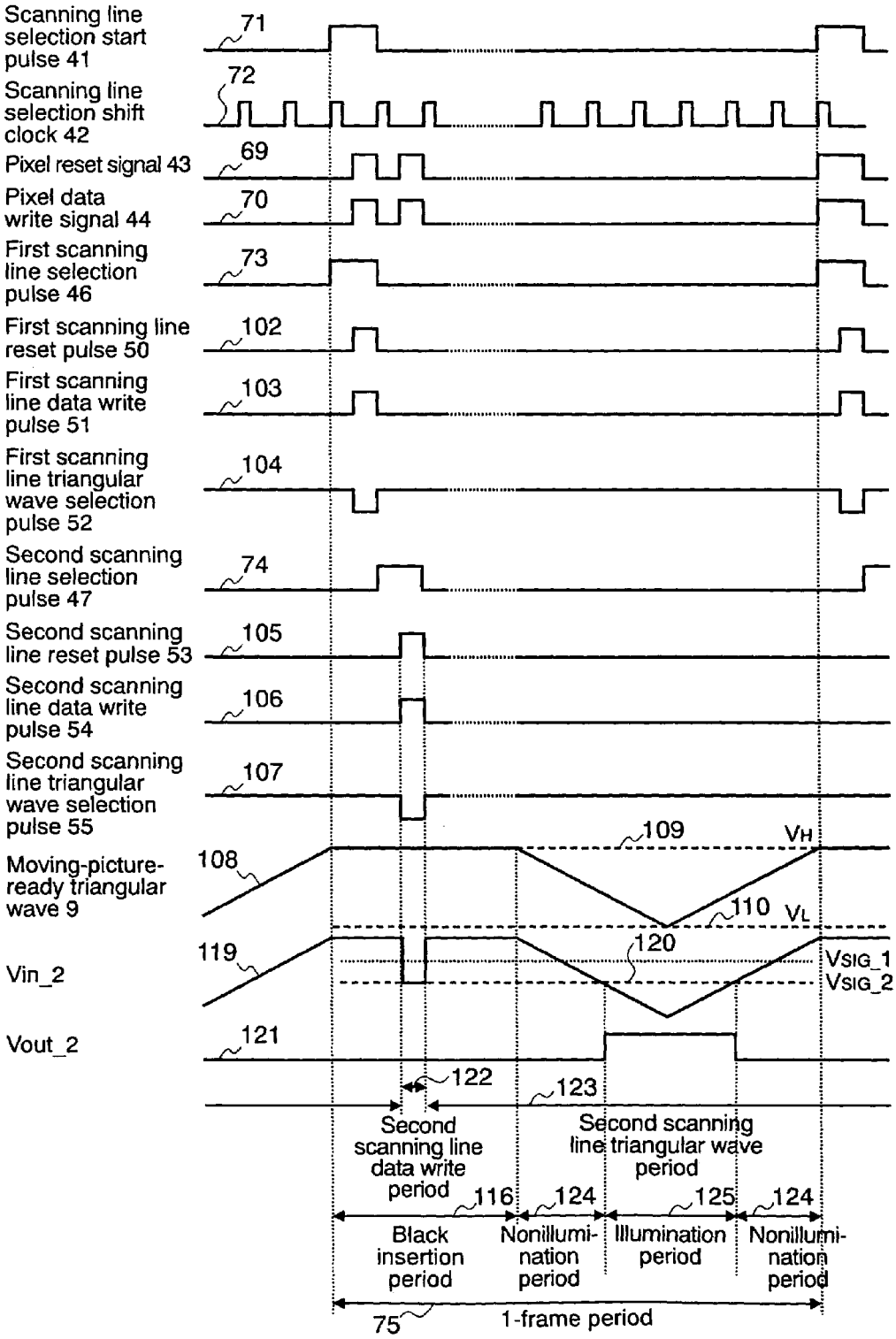
FIG. 8 illustrates an operation of a pixel write control signal generation circuit 49 and a signal voltage write operation of a second-row first-column pixel section, which differs from that of the above-mentioned first-row first-column pixel section.

FIG. 8 illustrates an operation of the pixel write control signal generation circuit 49 shown in FIG. 3 and a signal voltage write operation of a second-row first-column pixel section, which differs from that of the above-mentioned first-row first-column pixel section. The operation of the pixel write control signal generation circuit 49 shown in FIG. 3 will not be described herein because it is the same as described with reference to FIG. 7.

In FIG. 8, the reference numeral 119 denotes a second-row first-column pixel section drive inverter input; 120, a second-row first-column pixel section signal voltage; 121, a second-row first-column pixel section drive inverter output; 122, a second scanning line data write period; 123, a second scanning line triangular wave period; 124, a second-row first-column pixel nonillumination period; and 125, a second-row first-column pixel illumination period.

The second-row first-column pixel section drive inverter input 119 writes the second-row first-column pixel section signal voltage 120 (Vsig_2) while the second scanning line reset pulse waveform 105 is High during the second scanning line data write period 122. After termination of the write, the second scanning line triangular wave period 123 switches to the sweep signal waveform 108.

The potential Vsig_2 written herein is retained by the write capacitor 95 and used as a threshold voltage for the drive inverter 97. Therefore, the second-row first-column pixel section drive inverter output 121 is Low while the triangular wave voltage is higher than Vsig_2 during the second scanning line triangular wave period 123 and High while the triangular wave voltage is lower than Vsig_2.

Therefore, while the second-row first-column pixel section drive inverter output 121 is Low, the power supply to the organic EL element 98 is shut off so that a nonillumination period 124 results. While the first-row first-column pixel section drive inverter output is High, power is supplied to the organic EL element 98 so that an illumination period 125 results. When the sweep signal waveform 108 is a triangular wave High voltage 109, nonillumination results without regard to the Vsig_2 level as is the case with the first-row first-column pixel section. Therefore, the resulting display is such that the black insertion period 116 occurs for a black screen.

The moving-picture-ready drive under triangular waveform control will now be described with reference to FIGS. 1 and 8.

First of all, the flow of display data will be described with reference to FIG. 1. As indicated in FIG. 1, the moving-picture-ready self-luminous element based display control circuit 6 temporarily stores one screenful of display data 4 in the memory 13 as storage data 11. In accordance with the display timing of the self-luminous element based display unit 21, the moving-picture-ready self-luminous element based display control circuit 6 reads the display data from the memory 13 as screen read data 14, and generates the data line control signal 7 and scanning line control signal 8.

The memory 13 is usually used when the entered display data 4 does not agree with the display resolution of the self-luminous element based display unit 21. Therefore, the memory 13 may be excluded if the input resolution is exactly the same as the resolution of the self-luminous element based display unit 21.

Further, the moving-picture-ready self-luminous element based display control circuit 6 controls the illumination period of each pixel section of the self-luminous element based display unit 21 and generates the moving-picture-ready sweep signal 9 for black insertion control suitable for moving picture display. This moving-picture-ready black insertion period is longer than a single horizontal period (period for one-line scanning) and the data validity period 76. It is preferred that this black insertion period be 10% or longer but shorter than 60% of a 1-frame period 75. Further, moving pictures can be prevented from blurring when this black insertion period is varied.

The data line drive circuit 15 sequentially outputs the data line drive signal 16 as a signal voltage for displaying the data line control signal 7, which contains analog signal based gradation information, on the data line of the self-luminous element based display unit 21.

The scanning line drive circuit 17 outputs the pixel control drive signal 18 so as to control the pixel write control line of the self-luminous element based display unit 21. The drive voltage generation circuit 19 generates an organic EL drive voltage 20, which is used as the reference for generating a drive voltage for illuminating the organic EL element. In the self-luminous element based display unit 21, the pixel section on a scanning line selected by the pixel control drive signal 18 finally illuminates in accordance with the signal voltage of the data line drive signal 16, the moving-picture-ready sweep signal 9, and the organic EL drive voltage 20.

The operations of the data line drive circuit 15 and scanning line drive circuit 17 shown in FIG. 1 will now be described in detail with reference to FIGS. 2 through 4 and 7.

As indicated in FIG. 2, the data line control signal 7 contains a data latch start pulse 22 and a data shift clock 23. As indicated in FIG. 4, the data latch pulse shift circuit 27 shifts the data latch start pulse 22 in accordance with the data shift clock 23, and sequentially outputs the first dot data latch signal 28, second dot data latch signal 29, and so on to the 240th dot data latch signal 30.

As indicated in FIG. 4, the data switch circuit 31 outputs the analog R display data 24, analog G display data 25, and analog B display data 26, which are contained in the data line control signal 7, to the data line drive signal 16 as the first dot R signal 32, first dot G signal 33, and first dot B signal 34 in accordance with a selection made by the first dot data latch signal 28, as the second dot R signal 35, second dot G signal 36, and second dot B signal 37 in accordance with a selection made by the second dot data latch signal 29, and as the 240th dot R signal 38, 240th dot G signal 39, and 240th dot B signal 40 in accordance with a selection made by the 240th dot data latch signal 30.

As indicated in FIG. 3, the scanning line control signal 8 contains a scanning line selection start pulse 41 and a scanning line selection shift clock 42. As indicated in FIG. 4, the scanning line selection pulse shift circuit 45 shifts the scanning line selection start pulse 41 in accordance with the scanning line selection shift clock 42, and sequentially outputs the first scanning line selection pulse 46, second scanning line selection pulse 47, and so on to the 320th scanning line selection pulse 48.

When the first scanning line selection pulse 46 is High, the pixel write control signal generation circuit 49 outputs the pixel reset signal 43 and pixel write signal 44 as the first scanning line reset pulse 50 and first scanning line data write pulse 5, respectively, by using the pixel reset signal 43 and pixel write signal 44 contained in the scanning line control signal 8 and the first to 320th scanning line selection pulses 46-48 as indicated in FIG. 7, and generates an inverse output of the first scanning line data write pulse 51 as the first scanning line triangular wave selection pulse 52. Subsequently, when the scanning line selection pulses are High, the pixel write control signal generation circuit 49 sequentially outputs the pixel reset signal 43 and pixel write signal 44 as the scanning line reset pulses and scanning line data write pulses, respectively, and generates inverse outputs of the scanning line data write pulses as the scanning line triangular wave selection pulses.

The illumination operation of the self-luminous element based display unit 21 shown in FIG. 1 will now be described in detail with reference to FIGS. 5 through 8.

When the reset switch 96 is turned ON via the first line pixel reset control line 82, the input and output of the drive inverter 97 are shorted as indicated in FIG. 5. Therefore, the signal voltage write reference potential 101 becomes an intermediate potential for the potential difference between the input and output of the drive inverter 97 in accordance with the characteristic shown in FIG. 6.

When the first scanning line data write pulse 51 is supplied via the first line pixel write control line 81 in the above instance, the data write switch 93 turns ON. The data signal voltage is then stored into the write capacitor 95 via the first dot R data line 79 with reference to the signal voltage write reference potential 101. The stored signal voltage serves as the first-row first-column pixel section signal voltage 112 shown in FIG. 7. This voltage Vsig_1 is finally used as the threshold voltage for the drive inverter 97.

As indicated in FIG. 5, the drive inverter 97 generates a Low output when the input voltage is higher than the threshold voltage and generates a High output when the input voltage is lower than the threshold voltage. Therefore, when the first scanning line triangular wave selection pulse 52 is supplied via the first line triangular wave selection control line 83 to turn ON the triangular wave switch 94, the moving-picture-ready sweep signal 9 enters the drive inverter 97. Consequently, as shown in FIG. 7, the first-row first-column pixel section drive inverter output 113 generates a Low output during the nonillumination period 117 during which the triangular wave voltage is higher than the drive inverter threshold voltage Vsig_1 and a High output during the illumination period 118 during which the triangular wave voltage is lower than the drive inverter threshold voltage Vsig_1. In this instance, the organic EL element 98 is OFF while the output of the drive inverter 97 is Low and ON while the output of the drive inverter 97 is High. The organic EL element 98 illuminates when a drive current flows in accordance with the organic EL drive voltage 20.

If, as indicated in FIG. 8, a signal voltage Vsig_2 (<Vsig_1) that differs from the signal voltage written in the first-row first-column pixel section is written in the second-row first-column pixel section, it is stored in the write capacitor 95 with reference to the signal voltage write reference potential 101 and used as the second-row first-column pixel section signal voltage 120. This voltage Vsig_2 is then used as a threshold voltage for the drive inverter 97. The second-row first-column pixel section drive inverter output 121 generates a Low output during the nonillumination period 124 during which the triangular wave voltage is higher than the drive inverter threshold voltage Vsig_2 and a High output during the illumination period 125 during which the triangular wave voltage is lower than the drive inverter threshold voltage Vsig_2. Consequently, the organic EL element 98 shown in FIG. 5 is OFF while the output of the drive inverter 97 is Low and ON while the output of the drive inverter 97 is High. As a result, illumination occurs as a drive current flow in accordance with the organic EL drive voltage 20.

When the sweep signal level prevailing during the black insertion period 116 shown in FIGS. 7 and 8 is set so as not to invoke illumination without regard to the magnitudes of signal voltages Vsig_1 and Vsig_2, all the pixels on the screen can be rendered black.

When-time control for illumination/nonillumination is exercised in accordance with the signal voltage as described above, gradation display is achieved. Although the drive inverter 97 is depicted with a logic circuit symbol, it generally includes a CMOS transistor. However, any configuration is acceptable as far as the inverter has the characteristic shown in FIG. 6. The present invention does not limit the resolution or input display data format.

When a voltage level is provided for a sweep signal so that no illumination occurs for an arbitrary period without regard to the magnitude of a signal voltage, the first embodiment of the present invention improves the moving picture performance without converting input data for black insertion, furnishing a panel-mounted selector switch, or applying any other structural change.

Figure 9:
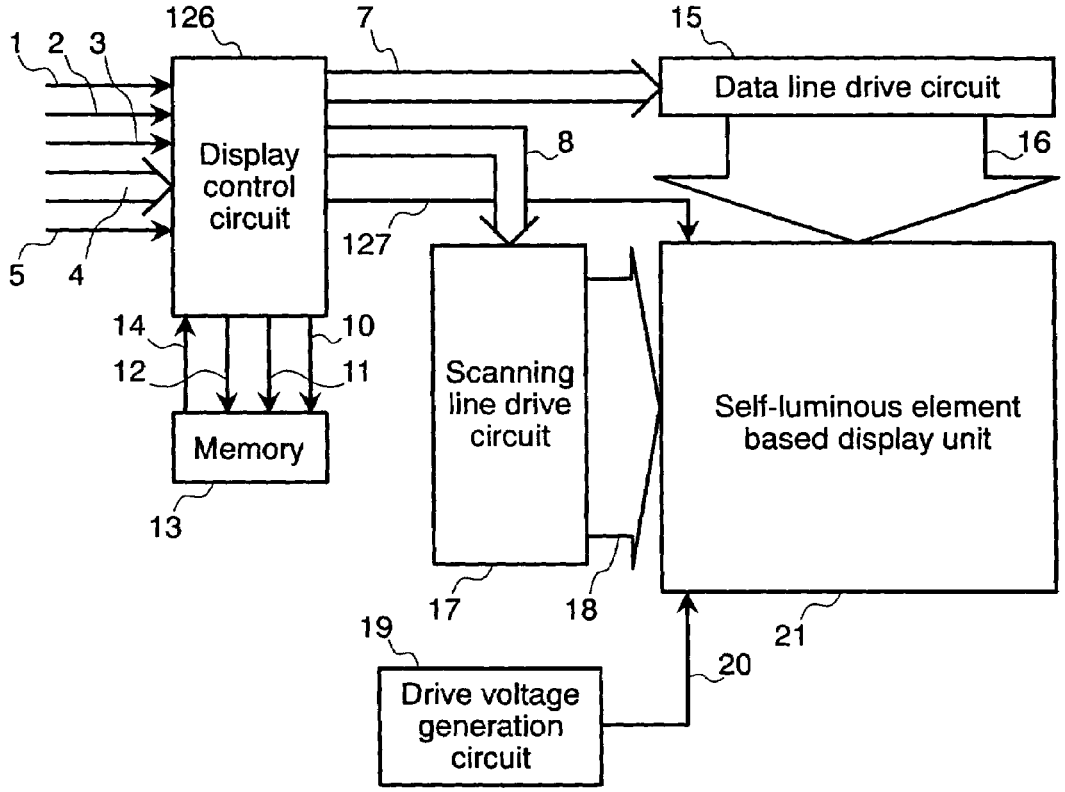
FIG. 9 is a block diagram illustrating a second embodiment of a self-luminous element based display device according to the present invention.

A second embodiment of the present invention will now be described with reference to the accompanying drawings. FIG. 9 shows an example of a self-luminous element based display device according to the second embodiment of the present invention.

Like elements in FIGS. 1 and 9 are designated by like reference numerals and will not be described herein because they are identical with the counterparts described in conjunction with the first embodiment. The reference numeral 126 denotes a display control circuit, and the reference numeral 127 denotes a video-ready sweep signal. The display control circuit 126 generates the video-ready sweep signal 127, which is a sweep signal suitable for input video. The ensuing explanation assumes that there are two types of input video: moving picture and still picture. In the other respects, the display control operation is the same as described in conjunction with the first embodiment.

Figure 10:
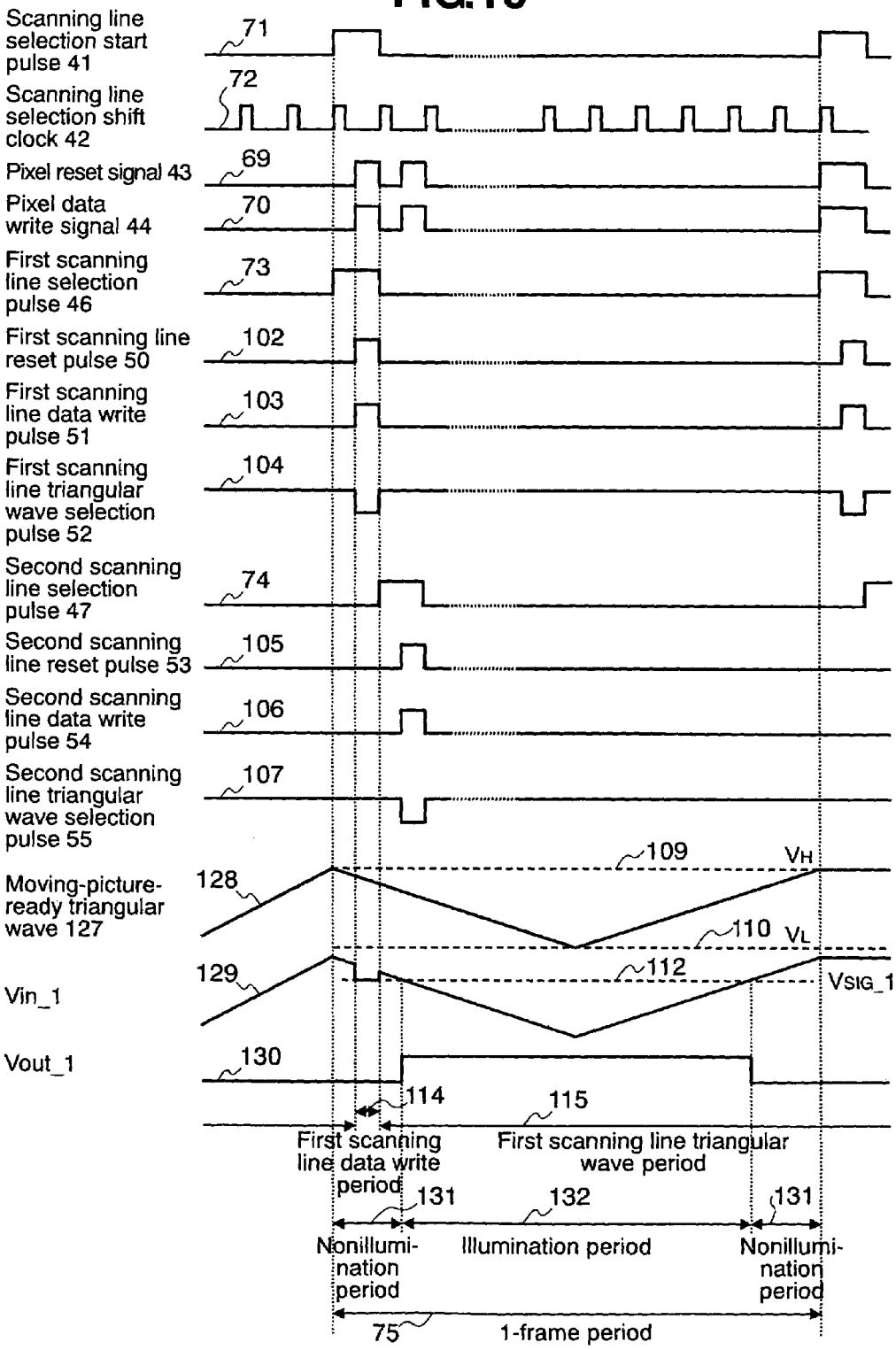
FIG. 10 illustrates how a display control circuit 126 performs the operation of a sweep signal generated for a still picture and the operation for controlling the illumination time with a signal voltage write and triangular wave.

FIG. 10 illustrates how the display control circuit 126 shown in FIG. 9 performs the operation of a sweep signal generated for a still picture and the operation for controlling the illumination time with a signal voltage write and triangular wave. The operation performed for a moving picture will not be described herein because it is the same as described in conjunction with the first embodiment. Further, like elements in FIGS. 7 and 10 are designated by like reference numerals and will not be described herein because they are identical with the counterparts described in conjunction with the first embodiment.

In FIG. 10, the reference numeral 128 denotes a still-picture-ready sweep signal waveform; 129, a still-picture-ready first-row first-column pixel section drive inverter input; 130, a still-picture-ready first-row first-column pixel section drive inverter output; 131, a still-picture-ready first-row first-column pixel nonillumination period; and 132, a still-picture-ready first-row first-column pixel illumination period.

The sweep signal waveform 128 remains constant as a triangular wave High voltage 109 ($V_H$) within a 1-frame period 75, varies to a triangular wave Low voltage 110 ($V_L$), and then reverts to the triangular wave High voltage 109. While the first scanning line reset pulse waveform 102 is High during the first scanning line data write period 114, the first-row first-column pixel section drive inverter input 129 writes the first-row first-column pixel section signal voltage 112 (Vsig_1). After termination of the write, the first scanning line triangular wave period 115 switches to the still-picture-ready sweep signal waveform 128.

The potential Vsig_1 written herein is retained by the write capacitor 95 and used as a threshold voltage for the drive inverter 97. Therefore, the still-picture-ready first-row first-column pixel section drive inverter output 130 is Low while the triangular wave voltage is higher than Vsig_1 during the first scanning line triangular wave period 115 and High while the triangular wave voltage is lower than Vsig_1.

Therefore, while the still-picture-ready first-row first-column pixel section drive inverter output 130 is Low, the power supply to the organic EL element 98 is shut off so that a still-picture-ready first-row first-column pixel nonillumination period 131 results. While the first-row first-column pixel section drive inverter output 130 is High; power is supplied to the organic EL element 98 so that a still-picture-ready first-row first-column pixel illumination period 132 results.

The illumination period according to the signal voltage is determined as described above. The ensuing explanation assumes that the above data input and triangular wave input operations are performed at regular intervals and within a 1-frame period 75, which represents a frequency of 60 Hz, as is the case with the first embodiment.

Video-ready triangular wave control according to the present embodiment will now be described with reference to FIGS. 9 and 10.

First of all, the flow of display data will be described with reference to FIG. 9. The display control circuit 126 shown in FIG. 9 judges whether the input display data is a moving picture or still picture, selectively generates either a moving-picture-ready sweep signal or still-picture-ready sweep signal, and outputs the generated signal as the video-ready sweep signal 127. In other words, when the moving-picture-ready sweep signal is generated, a necessary black insertion period 116 is provided (the black insertion period 116 is increased). When, on the other hand, the still-picture-ready sweep signal is generated, no particular black insertion period 116 is provided (the black insertion period 116 is decreased). The black insertion period 116 is varied depending on whether a moving picture or still picture is handled.

The description concerning the moving-picture-ready sweep signal will not be given herein because it is the same as for the first embodiment. The description concerning the still-picture-ready sweep signal will be given later. For differentiation between moving and still pictures, the input screen data may be compared against the screen data stored in the memory 13 to handle invariable pictures as still pictures. As an alternative, the system may transfer an identifier or other similar signal to indicate whether a still picture or moving picture is handled. In the other respects, the present embodiment is the same as the first embodiment.

FIG. 10 is used to describe in detail how the display control circuit 126 shown in FIG. 9 performs the operation of a sweep signal generated for a still picture and the operation for controlling the illumination time with a signal voltage write and triangular wave.

The still-picture-ready sweep signal waveform 127 shown in FIG. 10 differs from the moving-picture-ready sweep signal waveform in the first embodiment, and changes within a 1-frame period 75 from the triangular wave High voltage 109 to the triangular wave Low voltage 110 and then back to the triangular wave High voltage 109.

Therefore, the signal voltage is the same Vsig_1 as for the first embodiment. However, the still-picture-ready first-row first-column pixel illumination period 132 is longer than the first-row first-column pixel illumination period shown in FIG. 7. Thus, it indicates that the higher luminance results.

As described earlier, however, a moving-picture-ready sweep signal is generated for a moving picture. Therefore, the resulting illumination period is short. However, moving pictures can be prevented from blurring because a black insertion period is provided.

As described above, the second embodiment of the present invention changes the sweep signal waveform in accordance with the input display data unlike the first embodiment. Therefore, the second embodiment provides a drive method that is suitable for both moving pictures and still pictures, thereby improving the image quality of both of them.

The drive method suitable for both moving pictures and still pictures has been described above. However, since the luminance can be controlled with the triangular waveform, it is possible to control the triangular waveform according to the ambient environment or the user's taste. In any case, however, the purpose is achieved simply by changing the display control circuit 126. No system changes or panel pixel structure changes are required.

What is claimed is:

1. A display device comprising:

a plurality of pixel sections that are arranged in matrix format;

a data line driver for applying a signal voltage according to display data to each of the pixel sections;

a scanning line driver scanning rows of the pixel sections; and a display controller for applying a sweep signal to rows in the pixel sections; wherein the pixel sections control the illumination time within one frame period of the pixel sections in accordance with the result of comparison between the signal voltage and the sweep signal;

the sweep signal prevailing during one frame period has a first period during which the sweep signal is constant and a second period during which the sweep signal is triangular form;

the pixel sections do not illuminate during the first period, and the first period is greater than or equal to 10% of one frame period and less than 60% of one frame period.

2. A display device according to claim 1, wherein the first period is variable.

3. A display device according to claim 1, wherein the display controller changes the first period corresponding to whether the display data is a still picture or a moving picture.

4. A display device according to claim 1, wherein the display controller decreases the first period when the display data is a still picture and increases the first period when the display data is a moving picture.

5. A display device according to claim 1, wherein the sweep signal decreases gradually and then increases gradually during the second period.

* * * * *